US005992540A

United States Patent [19]

Smolinski et al.

[11] Patent Number: 5,992,540

[45] Date of Patent: Nov. 30, 1999

[54] AIR RATCHET HAND TOOL WITH THERMOPLASTIC JACKET

[75] Inventors: Gerald J. Smolinski, Bristol; Dale R. Landree, Kenosha, both of Wis.

[73] Assignee: Snap-on Tools Company, Kenosha, Wis.

[21] Appl. No.: 09/035,656

[22] Filed: Mar. 6, 1998

[51] Int. Cl.[6] ..... B25B 45/04

[52] U.S. Cl. ..... 173/169; 173/219; 173/DIG. 2; 173/171; 181/230

[58] Field of Search ..... 173/DIG. 2, 219, 173/168, 169, 170, 171; 181/230; 200/333

[56] References Cited

U.S. PATENT DOCUMENTS

| | | | |
|---|---|---|---|
| 2,453,240 | 11/1948 | Malmros | 181/230 |
| 3,402,779 | 9/1968 | Elmer | 173/170 |
| 3,753,469 | 8/1973 | Tuttle | 173/218 |
| 3,788,603 | 1/1974 | Snider | 251/345 |
| 4,303,131 | 12/1981 | Clark | 181/230 |
| 4,327,807 | 5/1982 | Emonet | 173/DIG. 2 |
| 4,466,851 | 8/1984 | Hoffman | 173/169 |
| 4,611,671 | 9/1986 | Hansson | 181/230 |
| 4,643,263 | 2/1987 | Karden | 181/230 |
| 4,879,847 | 11/1989 | Butzen et al. | 181/230 |
| 4,962,787 | 10/1990 | Mayhew | 173/170 |
| 5,189,267 | 2/1993 | Ligman | 181/230 |
| 5,244,521 | 9/1993 | Ligman | 181/230 |
| 5,309,714 | 5/1994 | Putney et al. | 173/219 |
| 5,311,949 | 5/1994 | Chapin | 173/170 |
| 5,383,771 | 1/1995 | Ghode et al. | 418/15 |
| 5,500,494 | 3/1996 | Ligman | 181/230 |
| 5,588,903 | 12/1996 | Pennison | 173/169 |
| 5,591,070 | 1/1997 | Kachich | 173/169 |

*Primary Examiner*—Peter Vo
*Assistant Examiner*—James P. Calve
*Attorney, Agent, or Firm*—Emrich & Dithmar

[57] ABSTRACT

An air ratchet hand tool has an elongated, generally cylindrical handle portion with an axial air inlet passage therethrough, and having an outer surface with two longitudinally extending channels formed therein, each communicating with the air motor. A thermoplastic grip jacket covers the handle portion and cooperates with the channels to form therebetween two exhaust air passages which exit at the distal end of the handle. Longitudinal ribs on the jacket project radially inwardly into engagement with longitudinal recesses in the handle portion to inhibit relative rotational movement, while a lug on the handle portion extends through an opening in the jacket to inhibit relative axial movement. A flexible and resilient trigger cover covers the valve trigger and the jacket opening through which it projects.

16 Claims, 4 Drawing Sheets

AIR RATCHET HAND TOOL WITH THERMOPLASTIC JACKET

BACKGROUND OF THE INVENTION

1. Field of the Invention

The present invention relates to power hand tools and, in particular, to pneumatic hand tools and the channeling of air therethrough.

2. Description of the Prior Art

Pneumatic hand tools, such as air ratchets, are well known. Typically, these hand tools have an elongated housing with a handle portion at one end and a head portion at the opposite end carrying a ratchet mechanism. An air motor is typically disposed in the housing intermediate the ends for driving the ratchet mechanism, the air motor being coupled to a source of pressurized air through an air inlet passage which commonly extends axially through the handle portion. The housing may be provided with a trigger, which may be in the form of a lever alongside the outside of the housing or a radially projecting button, adapted to be operated by a finger or fingers of the user's hand which grasps the handle, for operating an internal valve to admit air to the air motor. Typically, the housing and the handle portion thereof are formed of a suitable metal.

In prior air tools, various types of exhaust arrangements have been utilized. In one arrangement the air is exhausted from a forward portion of the housing, sometimes through a muffler arrangement. Commonly, the air exits the air motor into a circumferential passage or chamber which communicates with an exit opening at a forward portion of the housing. Alternatively, rear-exhaust arrangements have also been utilized, which include an exhaust passage which passes back through the handle portion, generally parallel to the inlet passage. While such an arrangement has the advantage of providing more effective cooling of the rear end of the air motor adjacent to the handle portion, it also requires a thicker handle portion to accommodate both the inlet and exhaust passages.

SUMMARY OF THE INVENTION

It is a general object of the present invention to provide an improved fluid-operated power hand tool which avoids the disadvantages of prior such hand tools while affording additional structural and operating advantages.

An important feature of the invention is the provision of a hand tool of the type set forth which permits rear air inlet and exhaust without requiring any increase in the size of the handle portion of the housing.

Yet another feature of the invention is the provision of a hand tool of the type set forth which provides a comfortable temperature for the user's hand when the tool is in operation.

In connection with the foregoing features, another feature of the invention is the provision of a hand tool of the type set forth, which provides a comfortable ergonomic grip for the handle portion of the tool housing.

Certain ones of these and other features of the invention may be attained by providing in a fluid-operated power hand tool including a housing having a handle portion and a fluid-operated motor in the housing and a fluid inlet passage through the handle portion communicating with the motor, the improvement comprising: an outer surface on the handle portion having an elongated channel formed therein and communicating with the motor, and a grip jacket covering the outer surface of the handle portion and cooperating with the channel to define a fluid exhaust passage.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
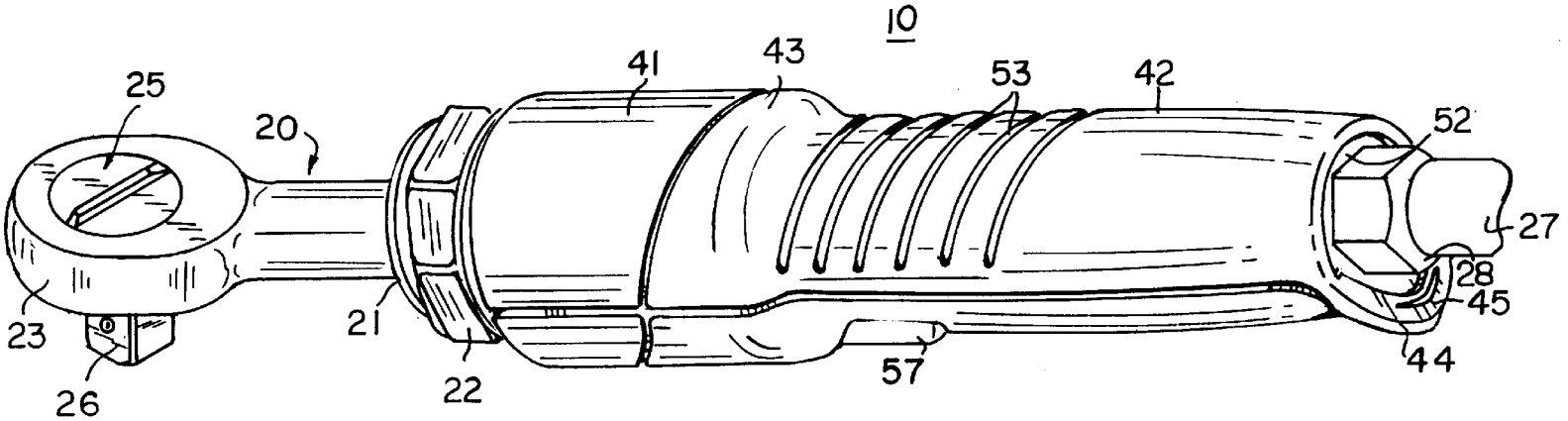
FIG. 1 is a perspective view of an air ratchet hand tool constructed in accordance with and embodying the features of the present invention.
Figure 9:
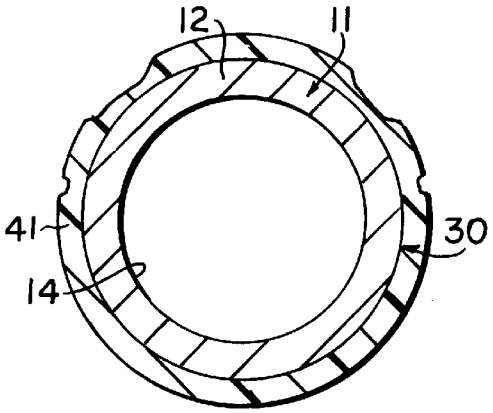
FIG. 9 is a view in vertical section taken along the line 9–9 in FIG. 3.
Figure 8:
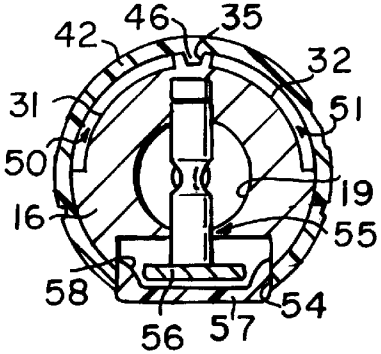
FIG. 8 is a view in vertical section taken along the line 8–8 in FIG. 3.
Figure 7:
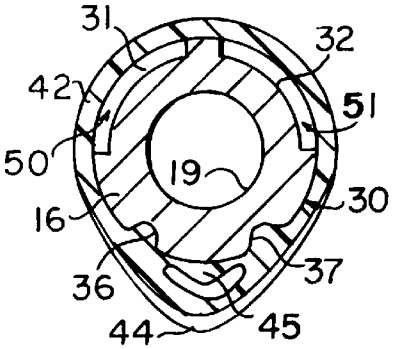
FIG. 7 is a view in vertical section taken along the line 7–7 in FIG. 3.
Figure 2:
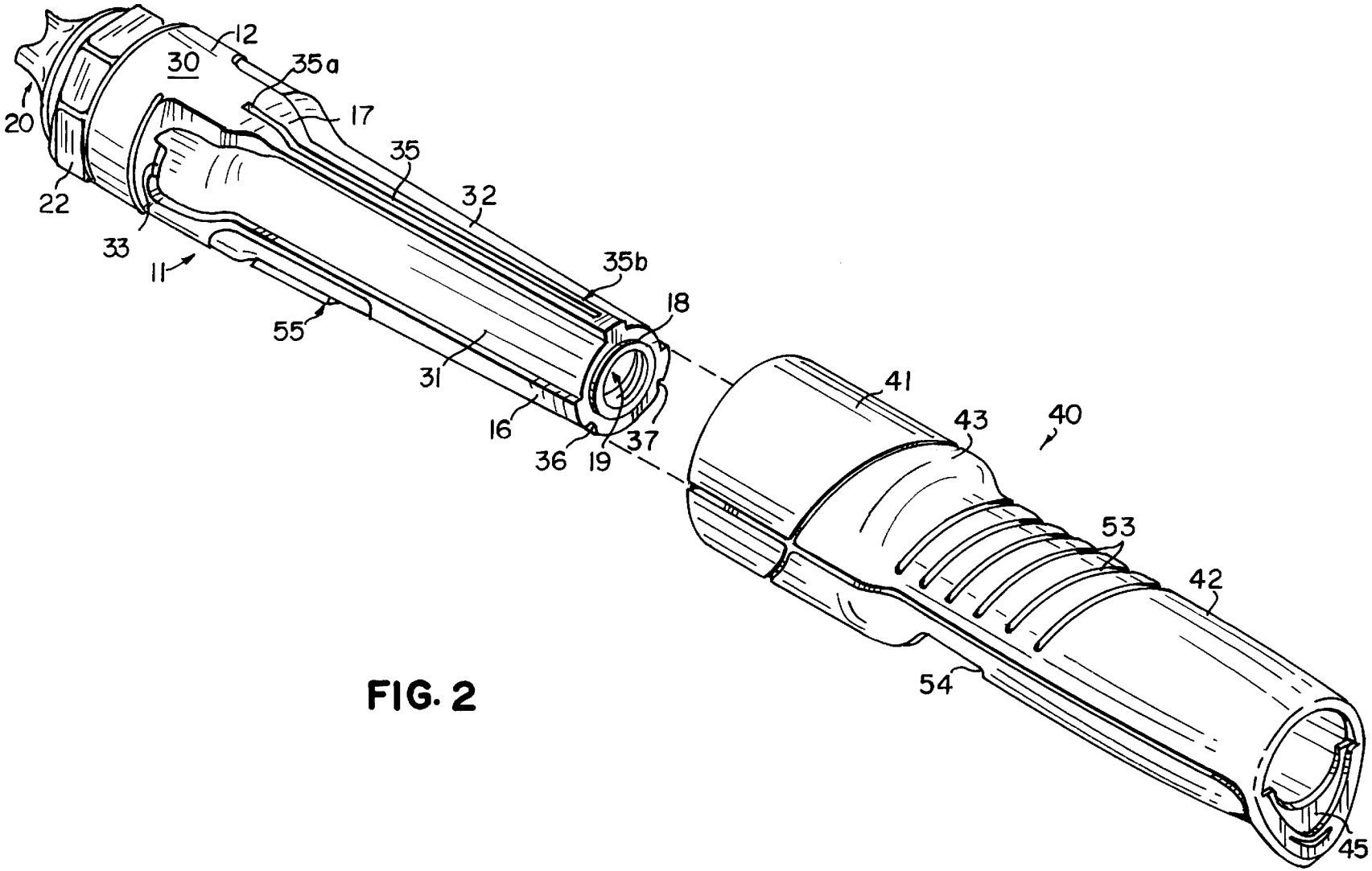
FIG. 2 is a fragmentary perspective view of the ratchet tool of FIG. 1, with the grip jacket separated.

Referring to FIGS. 1 and 2, there is illustrated a fluid-operated power hand tool in the nature of an air ratchet, generally designated by the numeral 10. The air ratchet 10 includes an elongated, generally cylindrical housing 11, preferably formed of a suitable metal, and having a main body 12 terminating in a front end 13 and defining therein an axial cavity 14 (see FIG. 9) in which an air motor 15 is mounted in a known manner. The housing 11 also includes an elongated, reduced-diameter handle portion 16 joined to the main body 12 by a sloping shoulder portion 17 and terminating at an annular end wall 18. The handle portion 16 has an axial bore 19 therethrough which communicates through a suitable valve mechanism (not shown) with the air motor 15, again in a known manner.

Coupled to the main body 12 of the housing 11 coaxially therewith is a ratchet housing 20 which has a rear coupling end 21 secured to the main body 12 by a clamp nut 22. The ratchet housing 20 has a head end 23 which carries a reversible ratchet mechanism 25 of known construction, provided with a drive lug 26 for coupling to associated driven socket tools. In use, compressed air is provided to the air ratchet 10 through an air inlet conduit 27 which is coupled to the axial bore 19 through a suitable fitting 28, all in a well-known manner.

Figure 6:
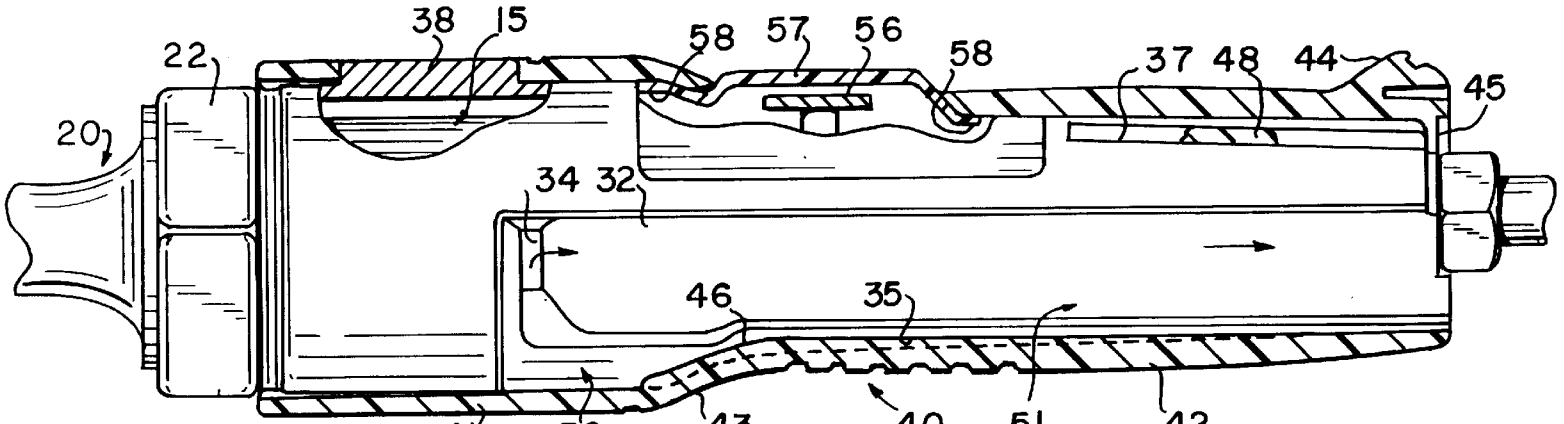
FIG. 6 is a side elevational view of the bottom side of the tool shown in FIG. 5, with portions broken away to more clearly shown internal construction.

The housing 11 has an outer surface 30, in which are formed two elongated channels 31 and 32, each extending substantially parallel to the axis of the housing 11 from intermediate the ends of the main body 12 all the way to the distal end of the handle portion 16. Each of the channels 31 and 32 is generally rectangular in shape, having a width substantially greater than its depth. The channels 31 and 32 respectively communicate with the air motor 15 through radial slots 33 and 34 at the forward ends of the channels (see also FIG. 6).

Referring now also to FIGS. 5–9, the outer surface 30 of the housing 11 has formed therein an elongated groove 35 disposed between the channels 31 and 32 and extending longitudinally from a forward end, disposed adjacent to the rear end of the main body 12, to a rearward end, disposed adjacent to the rear end of the handle portion 16. Preferably, the groove 35 has a varying depth which tapers gradually from a relatively deep forward end 35*a* to a rearward end 35*b* of negligible depth. Also formed in the outer surface 30 are two shorter, longitudinally extending grooves 36 and 37 (see FIGS. 5–7), each extending from the rear end of the handle portion 16 forwardly to end points approximately midway between the ends of the handle portion 16. Preferably, the grooves 36 and 37 are equiangularly spaced from opposite sides of a diametral plane which extends longitudinally of the handle portion 16 and passes through the groove 35. Projecting radially outwardly from the outer surface 30 approximately midway between the ends of the main body 12 on the side thereof opposite the groove 35 is a rectangular lug 38, for a purpose to be explained more fully below.

Figure 3:
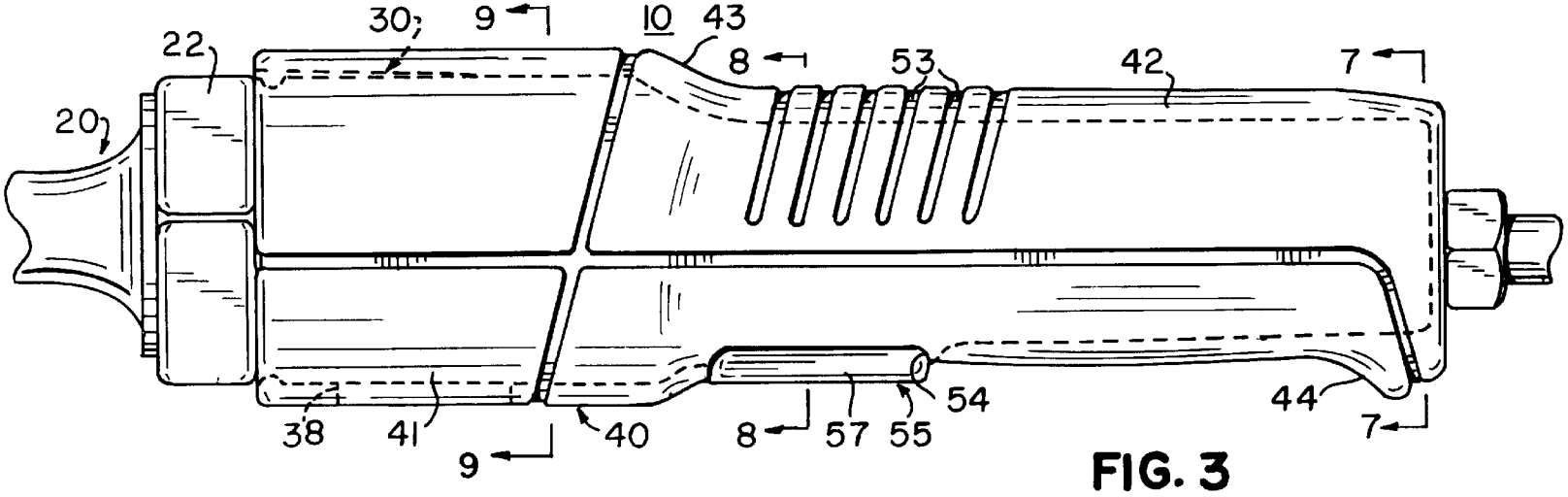
FIG. 3 is an enlarged, fragmentary, side elevational view of the rear portion of the tool of FIG. 1.
Figure 4:
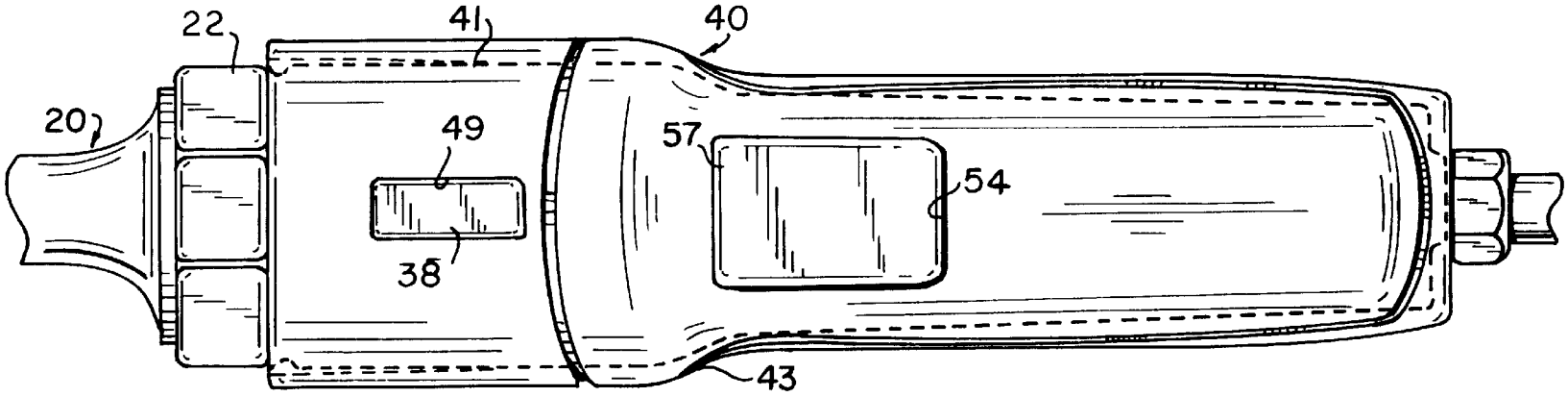
FIG. 4 is a fragmentary bottom plan view of the tool of FIG. 3.
Figure 5:
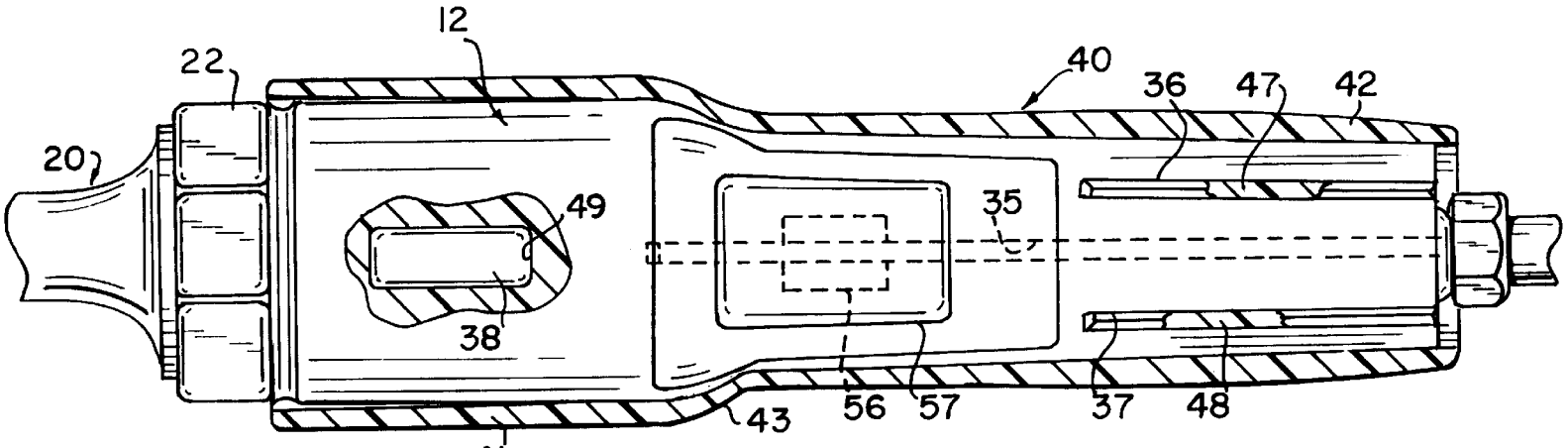
FIG. 5 is a view similar to FIG. 4 with portions broken away more clearly to show internal construction.

Referring now also to FIGS. 3 and 4, it is a fundamental aspect of the invention that there is provided a grip jacket 40 for covering the housing 11, the jacket 40 being formed of a flexible plastic material, preferably a suitable thermoplastic material which can be premolded. The jacket 40 generally matches the external shape of the housing 11, having a main portion 41, a handle portion 42 and a shoulder portion 43 which, respectively, in use cover the main body 12, the handle portion 16 and the shoulder portion 17 of the housing 11. The jacket 40 preferably has a tab projection 44 extending radially outwardly therefrom at the rear end thereof to assist in preventing a user's fingers from slipping rearwardly off the jacket 40, in use. Extending radially inwardly from the rear end of the jacket 40 is a partial end wall 45 which, in use, engages a portion of the end wall 18 of the housing 11 to serve as a stop to limit forward movement of the jacket 40 along the housing 11. Also projecting radially inwardly from the inner surface of the jacket 40 are a long rib 46 and two shorter ribs 47 and 48, which are dimensioned and arranged to mateably engage, respectively, in the grooves 35–37 in the outer surface of the housing 11 to prevent rotational movement of the jacket 40 relative to the housing 11. Also formed through the main portion 41 of the jacket 40 is a generally rectangular hole 49 (see FIGS. 4–6) dimensioned and arranged to receive therethrough the lug 38 when the jacket 40 is installed in its assembled position on the housing 11, as illustrated in FIGS. 1 and 3–9.

In assembly, the grip jacket 40 is designed to be slid over the rear end of the housing 11 in a rotational orientation so that the ribs 46–48, respectively, engage in the grooves 35–37, until the end wall 45 engages the housing end wall 18, at which point the lug 38 will snap into the hole 49, thereby effectively preventing removal of the jacket 40 from the housing 11. It will be appreciated that the jacket 40 is sufficiently flexible and resilient to accommodate this assembly operation.

It is a significant aspect of the invention that, when thus assembled, the inner surface of the grip jacket 40 fits snugly against the outer surface 30 of the housing 11 and cooperates with the channels 31 and 32, respectively, to define two elongated exhaust passages 50 and 51, both terminating at a part-annular exit opening 52 between the rear end of the jacket 40 and the rear end of the housing 11 (see FIGS. 1 and 6–8). Thus, it will be appreciated that, in use, air exhausted from the air motor 15 passes through the exit slots 33 and 34, respectively into the passages 50 and 51, and thence longitudinally therealong in the direction of the arrows in FIG. 6 to exit at the rear of the housing 11. There result exit passages for the air which substantially parallel the inlet passage formed by the axial bore 19, without requiring any additional cross-sectional dimension to the housing 11. Furthermore, the movement of the expanding exhaust air through the passages 50 and 51 serves effectively to cool the rear end of the air motor 15. The grip 40 is preferably formed of a thermally insulating material to provide a comfortable temperature for the user's hand. Furthermore, the grip jacket 40, in addition to cooperating with the housing 11 to form the exhaust passages, also serves as an ergonomic grip for the user's hand. In this regard, grooves 53 may be formed in the outer surface of the grip jacket 40 to facilitate gripping.

The grip jacket 40 and the housing 11 are arranged so that, in use, the palm of a user's hand rests on the top of the jacket 40, while his fingers wrap beneath the handle portion 42 of the jacket 40 just forwardly of the tab projection 44. In this regard, the air ratchet 10 is provided with a trigger assembly 55, which includes a radially inwardly extending valve actuator of known construction and a trigger pad 56, which extends through a generally rectangular opening 54 in the underside of the handle portion 42 of the jacket 40 adjacent to the shoulder portion 43. Preferably, there is also provided a trigger cover 57 formed of a suitable flexible and resilient material, such as a suitable plastic, which covers the trigger pad 56 and has a peripheral lip 58, which engages the inner surface of the jacket handle portion 42 around the periphery of the opening 54, as can best be seen in FIGS. 6 and 8.

From the foregoing, it can be seen that there has been provided an improved air ratchet tool with a plastic grip jacket which cooperates with the tool housing to define air exhaust passages and which also serves as an ergonomic grip for the user's hand.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. An improved exhaust system in a fluid-operated power hand tool including an elongated housing having a handle portion and a fluid-operated motor in the housing and a fluid inlet passage through a distal end of the handle portion communicating with the motor, the improvement comprising:

an outer surface on the handle portion and a distal end surface adjacent the fluid inlet passage intersecting the outer surface, the outer surface having an elongated channel formed therein and communicating with the motor and extending longitudinally of the handle portion to the distal end surface, and a detachable grip jacket formed of a flexible and resilient material covering said outer surface of the handle portion and having an inner surface that cooperates with said channel to define a fluid exhaust passage, said jacket having an open end defining an fluid exhaust opening for said exit passage and an end flange at said open end that engages the distal end surface of the handle portion to limit forward movement of the jacket on the handle.

2. The hand tool of claim 1, wherein said exhaust passage extends substantially parallel to the inlet passage.

3. The hand tool of claim 1, wherein said outer surface of the handle portion has plural spaced elongated channels formed therein, each communicating with the motor, said grip jacket cooperating with said channels for respectively defining plural exhaust passages.

4. The hand tool of claim 3, wherein the handle portion is generally cylindrical in shape, said handle portion having a valve trigger projecting radially therefrom at one side thereof, said exhaust passages being disposed on a side of said handle portion opposite said trigger.

5. The hand tool of claim 1, wherein said jacket is formed of a plastic material.

6. The hand tool of claim 5, wherein said jacket is formed of a thermoplastic material.

7. The hand tool of claim 6, wherein said jacket is formed of a thermally insulating material.

8. The hand tool of claim 1, wherein said tool is a pneumatic ratchet tool.

9. An improved exhaust system in a fluid-operated power hand tool including a housing having a handle portion and a fluid-operated motor in the housing and a fluid inlet passage through a distal end of the handle portion communicating with the motor, the improvement comprising:

an outer surface on the handle portion and a distal end surface adjacent the fluid inlet passage intersecting the outer surface, the outer surface having an elongated channel formed therein and communicating with the motor and extending longitudinally of the handle portion to the distal end surface, and a detachable grip jacket formed of a flexible and resilient material covering said outer surface of the handle portion and having an inner surface that cooperates with said channel to define a fluid exhaust passage, said jacket having an open end defining an exit opening for said fluid exhaust passage and an end flange at said open end that engages the distal end surface of the handle portion to limit forward movement of the jacket on the handle, one of the handle portion and the jacket having at least one recess therein and the other of the handle portion and the jacket having at least one projection engageable in said at least one recess when the grip jacket is assembled with the handle portion to inhibit movement of the jacket relative to the handle portion.

10. The hand tool of claim 9, wherein said at least one recess is formed in the handle portion and said at least one projection is formed on said jacket.

11. The hand tool of claim 10, wherein said at least one recess includes plural recesses and said at least one projection includes plural projections equal in number to said recesses.

12. The hand tool of claim 11, wherein each of said recesses and said projections extends longitudinally of the handle portion for inhibiting rotational movement of said jacket relative to the handle portion.

13. The hand tool of claim 12, wherein one of said grooves and one of said recesses has a radial depth which tapers from a maximum depth adjacent to a forward end of the handle portion to a substantially zero depth adjacent to the distal end of the handle portion.

14. The hand tool of claim 10, and further comprising a lug projecting radially outwardly from the outer surface of the handle portion, and an aperture in said jacket receiving said lug therethrough for inhibiting axial motion of said jacket relative to the handle portion.

15. The hand tool of claim 9, wherein the outer surface of the handle portion has two channels therein extending longitudinally of the handle portion, said jacket cooperating with said channels for forming two exhaust passages, said recess and said projection extending longitudinally of the handle portion between said exhaust passages.

16. The hand tool of claim 9, wherein the handle portion has a valve-actuating trigger projecting radially therefrom, said jacket having an opening therein receiving said trigger therethrough, and further comprising a flexible and resilient trigger cover mounted to said grip jacket around the periphery of said opening and covering said trigger in use.

* * * * *

UNITED STATES PATENT AND TRADEMARK OFFICE

CERTIFICATE OF CORRECTION

PATENT NO : 5,992,540

DATED : Nov. 30, 1999

INVENTOR(S) : Gerald J. Smolinski
Dale R. Landree

It is certified that error(s) appear in the above-identified patent and that said Letters Patent are hereby corrected as shown below:

Column 5, line 5, "fluid exhaust" should be -- exit --.

Column 5, line 6, "exit" should be -- fluid exhaust --.

Signed and Sealed this

Eighth Day of May, 2001

*Attest:*

Nicholas P. Godici

NICHOLAS P. GODICI

*Attesting Officer*

*Acting Director of the United States Patent and Trademark Office*